United States Patent [19]

Sandiford et al.

[11] Patent Number: 4,501,324

[45] Date of Patent: Feb. 26, 1985

[54] METHOD FOR IDENTIFYING THE SOURCE OF AN OIL

[75] Inventors: Burton B. Sandiford, Placentia; E. Reinold Fett, Fullerton; Harold J. Bickford, Placentia, all of Calif.

[73] Assignee: Union Oil Company of California, Los Angeles, Calif.

[21] Appl. No.: 453,506

[22] Filed: Dec. 27, 1982

[51] Int. Cl.[3] ..... E21B 47/10; E21B 43/22

[52] U.S. Cl. ..... 166/250; 166/252; 166/369; 436/27

[58] Field of Search ..... 166/250, 252, 275, 273, 166/113, 371, 68, 105, 106, 274, 371, 369; 436/27-29; 175/42, 40

[56] References Cited

U.S. PATENT DOCUMENTS

| | | | |
|---|---|---|---|
| 2,180,400 | 11/1939 | Coberly | 166/369 X |
| 3,435,672 | 4/1969 | Ten Brink et al. | 436/27 X |
| 3,703,926 | 11/1972 | Roeder | 166/106 |
| 3,799,261 | 3/1974 | Deans et al. | 166/250 |
| 3,833,060 | 9/1974 | Craggs et al. | 166/369 X |
| 3,847,548 | 11/1974 | Keller | 166/252 X |
| 3,993,131 | 11/1976 | Riedel | 166/252 |
| 4,011,908 | 3/1977 | Holm | 166/273 |
| 4,022,276 | 5/1977 | Dreher et al. | 166/250 |
| 4,055,399 | 10/1977 | Parrish | 436/27 |
| 4,141,692 | 2/1979 | Keller | 44/59 |
| 4,303,411 | 12/1981 | Chen et al. | 166/252 X |

*Primary Examiner*—Stephen J. Novosad

*Attorney, Agent, or Firm*—Dean Sandford; Gregory F. Wirzbicki; Gerald L. Floyd

[57] ABSTRACT

A method for tagging an oil so that subsequently it may be identified as to source by incorporating into the oil as a tracer material a minor amount of certain halohydrocarbons or halocarbons, utilizing the so-tagged oil in any desired manner wherein control of the oil is at least temporarily lost, and thereafter analyzing an oil suspected to contain at least a portion of the so-tagged oil for the presence of the tracer material by gas chromatography, using a pulsed election capture detector.

15 Claims, No Drawings

METHOD FOR IDENTIFYING THE SOURCE OF AN OIL

BACKGROUND OF THE INVENTION

1. Field of the Invention

This invention relates to a method for tagging an oleaginous and petroliferous substance so that it subsequently may be identified as to source. More particularly, the invention relates to such a method wherein control of the so-tagged substance is temporarily lost, as when it is stolen, spilled, misplaced or injected down a well and/or into a subterranean reservoir.

2. Description of the Prior Art

Sometimes one has in his control a first oleaginous and petroliferous substance. This control can then be lost. The loss can be deliberate, as when an oil is injected down as well as a power fluid in a method for pumping reservoir oil out of a subterranean reservoir, or when an oil is injected into a subterranean reservoir in an enhanced oil recovery process or in a study of the flow conditions within a reservoir. The loss can also be inadvertent, as when an oil is spilled or stolen. Subsequently, there can come within one's control a second oleaginous substance which is suspected either to be or to contain a portion of the first oleaginous substance. This second oleaginous substance may be oil produced from a subterranean reservoir, discovered under circumstances arousing suspicion that it may be oil previously stolen or spilled, or encountered in any of a number of other circumstances.

Such oleaginous substances are difficult to identify. Some oleaginous and petroliferous substances, such as crude oil, have such a complex structure that their compositions are difficult to define and distinguish from each other. Other such substances, such as fractions of crude oil, have compositions so much alike that one sample from one source is difficult to distinguish from another sample from a different source. In either of the above instances tracing a given sample of oil whose origin is unknown back to its source can prove onerous.

One instance in which control of an oil is deliberately lost is during its use as a power fluid in an oil production method. There are diverse methods for producing oil from an oil-bearing reservoir. If the reservoir does not have sufficient pressure so that a well penetrating the reservoir flows oil in sufficient volume to make production practical, a pump may be installed in the well to lift the oil to the surface. One type of pump which can be used is a downhole production pump activated by hydraulic fluid pressure applied from the surface of the earth. In other instances it may be necessary to inject an enhanced oil recovery medium into the reservoir via an injection well to displace the reservoir oil and drive it to one or more production wells. The enhanced recovery fluid can be a miscible, microemulsion, or micellar solution, a composition which contains oil as well as water, a surfactant and perhaps also a cosurfactant. In still other instances, as in studying the flow characteristics of a fluid passed through a reservoir, it is sometimes desired to inject an oil into a reservoir via one well, produce fluids from the reservoir via the same well or one or more offset wells, and examine the produced fluid to determine if any of the injected oil is present therein. Instances in which control of an oil is inadvertently lost include theft and spillage of an oil.

Regardless of how control of a first oil is lost, it often occurs that one comes into control of a second oil, such as by producing an oil via a well penetrating a subterranean reservoir, or by locating a body of oil, which second oil is suspected of being or containing a portion of the first oil.

It is often difficult to compare a first oil and a second oil by chemical analysis. To facilitate such a comparison, it is known to add a tracer material to a fluid injected into a subterranean reservoir via a well and to examine a fluid subsequently produced from the reservoir via the same or a different well for the presence of the tracer material. Numerous materials have been suggested as tracer materials including radioactive materials, such as iodine$^{131}$ and other chemical compounds not commonly present in reservoir fluids in significant concentrations and which are easily detected in small concentrations by conventional analytical techniques. In U.S. Pat. No. 4,141,692 to Keller there is described a composition of a liquid fuel, such as gasoline, containing certain types of chlorohydrocarbon or chlorocarbon tracers, which tracers can be detected by gas chromatography, using a pulsed electron capture detector. While known tracer materials have proven useful in many oil tracing methods, the need persists for a further improved method for tracing a first oil, particularly where the first oil is injected down a well, perhaps even out into the reservoir penetrated by the well, and a second oil is recovered via the same or another well in communication with the same reservoir and examined to see if the second oil is or contains a portion of the first oil.

Therefore, it is a principal object of this invention to provide a method for tracing an oil.

It is a further object to provide such a method wherein an oil-soluble tracer material is added to a first oil, control of the first oil is lost, and subsquently a second oil is located and analyzed for the presence of the tracer added to the first oil.

It is a still further object to provide such a method for evaluating the volume of reservoir oil produced from a well utilizing a hydraulic bottom hole piston pump actuated by a power fluid.

It is another object to provide such a method for investigating the dynamic conditions of fluid flow through a subterranean reservoir penetrated by one or more wells.

It is yet another object to provide such a method wherein the flow of an enhanced oil recovery fluid through the reservoir is monitored.

It is still another object to provide such a method wherein an oil or an oil base fluid containing a tracer material is injected into the reservoir via one well, reservoir fluids are produced via the same or a different well and the produced fluids are analyzed for the presence of the tracer material.

Other objects, advantages and features of this invention will become apparent to those skilled in the art from the following description and appended claims.

SUMMARY OF THE INVENTION

Briefly the invention provides a method for tracing a first oil comprising (1) adding to the first oil as a tracer material a halogenated hydrocarbon component comprising at least one halohydrocarbon or halocarbon containing at least 3 halogen atoms and at least 2 carbon atoms per molecule and having a halogen/carbon atomic ratio of at least one third; (2) utilizing the tracer-containing first oil; (3) recovering a second oil suspected to be or to contain a portion of the so-utilized first oil; and (4) analyzing the second oil for the presence of the tracer material, as by means of an electron capture detector, as it elutes from a gas chromatograph.

In one particular embodiment of the invention, the invention provides a method for monitoring the production of oil from a reservoir penetrated by a well utilizing a downhole production pump having a closed hydraulic pumping system utilizing as a power fluid an oil containing a tracer material to determine the amount of leakage of power fluid into the production stream.

In another particular embodiment of the invention, the invention provides a method for investigating the dynamic conditions of fluid flow in a permeable subterranean reservoir penetrated by one or more wells wherein there is injected into the reservoir via one well an oil or an oil base fluid containing a minor amount of the tracer material, fluids are produced from the reservoir via the same or another well, and the produced fluid is analyzed for the presence of the tracer material.

Yet another particular embodiment of the invention provides a method for tagging a first oil with a tracer material so that if control of the first oil is lost, a subsequently recovered oil can be analyzed to determine if it is or contains a portion of the first oil.

DETAILED DESCRIPTION OF THE INVENTION

Oil, especially petroleum crude oil, is often a complex mixture of chemical compounds. In contrast, refined fractions of an oil are often quite similar in composition. With either type of oil, establishing by chemical analysis whether one sample of oil has the same source as another sample of oil can be difficult.

Such oil is utilized in many different ways wherein control of the oil is temporarily lost. Such utilization can include production of oil using a downhole pump actuated by an oil power fluid or injection of oil into a subterranean reservoir as in an enhanced oil recovery process using a micellar solution or in a study of the flow of fluids through the reservoir. In other instances a body of oil can be lost, stolen, or spilled. In the method of this invention a minor amount of a particular oil-soluble tracer material not normally present in oil in a significant concentration is added to a first oil, control of the first oil is lost, control of a second oil is established, and the second oil is analyzed for the presence of the tracer material. If the tracer material is found in the second oil, it is established that the second oil is the same as, or contains a portion of, the first oil.

The preferred tracer compounds for use in the method of this invention contain from 3 to about 8 halogen atoms and 2 to 10 carbon atoms per molecule, and have a halogen/carbon atomic ratio between 0.5 and 3. The halogen atoms are selected from the group comprising chlorine, fluorine, bromine, iodine and mixtures thereof. The halogen atoms in a tracer material can be either all the same, for example tetrachloroethylene and trifluoroethane, or mixed, for example difluoro-1-chloroethane and difluoro-1,2-dibromoethane. From the standpoint of gas chromatography detectability, it is further preferred that at least 2 halogen atoms per molecule be bonded to the same or adjacent carbom atoms, and/or that at least one halogen atom, preferably at least 2, be bonded to an olefinic carbon atom. Exemplary preferred tracer compounds for oils are as follows:

TABLE

| | Boiling Pt., °C. | Melting Pt., °C. |
|---|---|---|
| 1. Trichloro ethylene | 87.2 | −73 |
| 2. 1,1,2-trichloro ethane | 113.5 | −37 |
| 3. Tetrachloro ethylene | 121 | −22 |
| 4. 1,1,2,2-tetrachloro ethane | 146 | −36 |
| 5. Pentachloro ethane | 162 | −29 |
| 6. Hexachloro ethane | 186 (777 mm) | 187 |
| 7. 1,2,4-trichloro benzene | 213 | 17 |
| 8. 1,2,4,5-tetrachloro benzene | 240–46 | 138–40 |
| 9. Pentachloro benzene | 275–77 | 85–6 |
| 10. Dichloro-1,2-dibromoethane | 194.5 | −26 |
| 11. Dichlorotribromethane | 210 | 16.8 |
| 12. Hexafluoro benzene | 80.2 | 5.2 |
| 13. Difluoro-1-chloroethane | −9.2 | −130.8 |
| 14. Difluoro-1,2-dibromoethane | 9.3 | −56.5 |
| 15. Trifluoro-1,1,2-trichloroethane | 47.6 | −35 |
| 16. Trifluoro-1,2-dibromoethane | 76.5 | — |
| 17. Tetrabromoethylene | 226 | 56.7 |
| 18. Tribromopropane | 219 | 16.7 |
| 19. Dibromobutane | 157 | −34.5 |
| 20. Dibromobenzene | 221 | 1.8 |
| 21. Diiodobutane (1,4) | 120 | 5.8 |
| 22. Diiodobenzene (o) | 286 | 27 |

The tracer material is added to the oil in an amount detectable by gas chromatography using a pulsed electron capture detector. If little dilution of the oil is expected, as low as 10 weight parts per million tracer material can be used. The tracer material can be added directly to the oil to be tagged, either batchwise accompanied by agitation or continuously as when the oil is being injected down a well. The amount of tracer material to be used depends primarily on the subsequent use of the trace-containing oil. If the oil is to be used in monitoring a downhole hydraulic pumping system during production of reservoir oil, about 50 to 250 weight parts per million of the tracer material should be used in the oil power fluid. When the oil is to be injected into a subterranean reservoir, as in an enhanced oil recovery process or an investigation of the dynamic conditions of fluid flow in the reservoir, there is a possibility the oil will be highly diluted with reservoir fluids before eventually being recovered from the reservoir. Thus, about 250 to 10,000 weight parts per million of the tracer material should be added to oil to be injected into a reservoir. Further, the particular tracer materials can vary in their sensitivity to detection in the election capture detector, and the amount of each which should be used will vary depending on this sensitivity. Since the amount of tracer material employed is small compared with the amount of oil to which it is added, in some instances it may be desirable to prepare a concentrated solution of the tracer material in an oil solvent. Generally about 1,000 to 100,000 weight parts per million tracer material in an oil solvent can be used. The oil solvent can be any solvent in which the tracer material is soluble or dispersible and which is soluble in the oil to which the tracer material is to be added. Suitable solvents include crude oil, a fraction of a crude oil, an aliphatic hydrocarbon such as pentane or hexane, or an aromatic hydrocarbon such as benzene, toluene or xylene.

Oils to which the tracer materials may be applied include crude oil and the various refined fractions of crude oil.

Effective chromatographic separations for the present purposes can be obtained using either the polar or non-polar, boiling-range type of column:

In the following examples, the chromatograph method employed is as follows:

| Temperatures °C. | |
|---|---|
| Injection Port | 200° |
| Column | Programmed from 70 to 150° at 6°/min., or isothermal at 150°. |
| Detector | 220° |
| Carrier Gas | Nitrogen, ultra pure grade |
| Detector | Pulsed Electron Capture |
| Sample Size | 0.1 microliter |
| Column | 50 feet × 0.02 inch support-coated open tube, OV-101 boiling range stationary phase. |
| Syringe | Hamilton #7001 |

Gas flow through the sample injection port is 35 ml./min., but only 5 ml./min. is passed through the column, the remainder being exhausted from the system in order to decrease the sample size. Make-up nitrogen is then added to the column effluent in order to provide the 35 ml./min. flow required in the detector.

The invention is further illustrated by the following examples which are illustrative of various aspects of the invention and are not intended as limiting the scope of the invention as defined by the appended claims.

EXAMPLE I

One method for pumping oil from a reservoir penetrated by a well to ground level is by means of a hydraulic activated downhole production pump assembly. A well is equipped with three separate parallel tubing strings. A bottom hole unit comprising an engine, control valves and a pump is attached to the lower end of the tubing strings. In a closed power fluid system, an oil power fluid is pumped in continuous unidirectional flow down the first well tubing under moderately high pressure supplied by a pump at the surface. The power fluid is in communication with and operates a double action piston in the engine at the bottom of the well. The piston of the engine is mechanically connected, as by a rod, with the piston of the pump. On the upstroke, the power fluid is applied against the bottom of the piston of the engine forcing this piston, and hence also the piston of the pump connected thereto, up. The standing valve, commonly a ball valve in the pump, opens and reservoir fluid is drawn into the pump cylinder. On the downstroke, the power fluid is applied against the top of the piston of the engine forcing this piston, and hence also the piston of the pump connected thereto, down. The standing valve closes, and the reservoir fluid in the pump cylinder is forced out into and up the second well tubing to the surface. The exhausted power fluid on each stroke of the piston passes out into the up the third well tubing to the surface where it is recirculated.

It sometimes happens that such downhole production pumps, after being in service for some time, develop leaks wherein some of the injected power fluid leaks into the production stream. Thus, the produced fluid contains a combination of reservoir oil and power fluid. Under normal operating conditions it is difficult to accurately measure the concentration of power fluid in the produced fluid by the use of volume meters. However, if a known concentration of a tracer material of this invention is added to the power fluid and the concentration of tracer in the produced fluid is determined, the relative amounts of reservoir oil and power fluid in the produced fluid can be accurately calculated.

A California well producing a mixture of oil and water is equipped with a Reda hydraulic actuated downhole production pump assembly having a closed power fluid system. It is suspected that a portion of the power fluid is leaking into the produced fluids during production, and it is desired to determine the extent of this leakage. Tetrachloroethylene is added as a tracer material to the power fluid going into the well at a concentration of 160 weight parts per million for a period of 6 hours. Samples are periodically taken both of the produced power fluid and the produced reservoir fluids suspected to contain a portion of the tracer-tagged power fluid. A chromatographic analysis of each of the samples is made as is described above. The volume percent of reservoir oil in the produced oil is calculated as follows:

$$\% \text{ Reservoir Oil} = \frac{\text{Maximum Tracer in Power Fluid Return} - \text{Maximum Tracer in Production Stream}}{\text{Maximum Tracer in Power Fluid Return}} \times 100$$

$$\frac{(131 - 105)}{131} \times 100 = \sim 20$$

The well produces production fluids at the rate of 191 barrels per day. Water constitutes 74.3 percent of the total production. Thus, 49 barrels per day of oil is produced. Twenty percent of this oil is calculated to be reservoir oil and the remainder power fluid which leaks into the production system. Therefore, of the 49 barrels per day of produced oil, 10 barrels is reservoir oil and 39 barrels is leaked power fluid. The invention provides an excellent tool for determining the volume of reservoir oil produced from the well.

EXAMPLE II

A flooding operation is conducted in an oil-containing reservoir in accordance with the method of this invention. An object of this operation is to determine when the flooding medium reaches a production well. Four injection wells are arranged in a rectangular pattern around a centrally located production well. Different halohydrocarbon tracer materials are added to four different batches of crude oil previously produced from the reservoir in a concentration of 1,000 weight parts per million. The tracers selected are tetrachloroethylene, hexafluoro benzene, tetrabromoethylene and diiodobutane. Four batches of displacement fluid comprising a microemulsion prepared by admixing 50 percent by volume of crude oil containing the different tracer materials, 5 percent isopropyl alcohol, 10 percent preferentially oil-soluble alkyl aryl sulfonate, 5 percent preferentially water-soluble alkyl aryl sulfonate, and 30 percent water. Different microemulsions are injected into each of the four different injection wells at injection rates of about 35 barrels per day until a total amount of microemulsion equivalent to about 0.10 reservoir pore volume is injected. Thereafter aqueous flooding medium drive fluid is injected into the reservoir through each of the injection wells at a rate of 40 barrels per day and petroleum and other produced fluids are recovered from the control producing well. A sample of the oil component of the produced fluids is taken and analyzed weekly by gas chromatography, using a pulsed electron capture detector, for the presence of any of the tracer materials. After 3 years 9 months and 1 week from the start of injection of the microemulsion, traces of tetrachloroethylene appear in the produced oil. This information allows changes in the pattern of drive fluid injected into the injection wells to more efficiently produce the reservoir.

While various specific embodiments and modifications of this invention have been described in the foregoing specification, further modification will be apparent to those skilled in the art. Such further modifications are included within the scope of this invention as defined by the following claims:

We claim:

1. A method for tracing a first oil comprising:
(a) incorporating into said first oil a halogenated hydrocarbon tracer material component comprising at least one halohydrocarbon or halocarbon containing at least 3 halogen atoms and at least 2 carbon atoms per molecule, and having a halogen/carbon atomic ratio of at least one third;
(b) injecting said first oil into a subterranean reservoir;
(c) obtaining from said reservoir a second oil suspected to be or to contain a portion of the first; and
(d) analyzing the second oil for the presence of the halohydrocarbon or halocarbon component by gas chromatography, using a pulsed electron capture detector.

2. The method defined in claim 1 wherein said halohydrocarbon or halocarbon is added as a concentrated solution in an oil solvent.

3. The method defined in claim 1 wherein said halocarbon is tetrachloroethylene.

4. A method for determining the amount of leakage of an oil power fluid into reservoir fluids during production of reservoir fluids from a well by a hydraulic actuated downhole production pump assembly having a closed power fluid system comprising:
(a) incorporating into the power fluid about 50 to 250 weight parts per million of a halogenated hydrocarbon tracer material component comprising at least one halohydrocarbon or halocarbon containing at least 3 halogen atoms and at least 2 carbon atoms per molecule, and having a halogen/carbon atomic ratio of at least one third,
(b) utilizing the power fluid to produce via separate conduits a produced fluid and a returned power fluid,
(c) analyzing both the produced fluid and the returned power fluid for the concentration of halohydrocarbon or halocarbon contained therein by gas chromatography, using a pulsed electron capture detector, and
(d) calculating the relative amounts of reservoir oil and returned power fluid in the produced oil.

5. The method defined in claim 4 wherein said halohydrocarbon or halocarbon is added as a concentrated solution in an oil solvent.

6. The method defined in claim 4 wherein said halocarbon is tetrachloroethylene.

7. A method for determining the amount of leakage of an oil power fluid into reservoir fluids during production of reservoir fluids from a well by a hydraulic actuated downhole production pump assembly having a closed power fluid system consisting essentially of:
(a) incorporating into the power fluid about 50 to 250 weight parts per million of a halogenated hydrocarbon tracer material component consisting essentially of at least one halohydrocarbon or halocarbon containing at least 3 halogen atoms and at least 2 carbon atoms per molecule, and having a halogen/carbon atomic ratio of at least one third,
(b) utilizing the power fluid to produce via separate conduits a produced fluid and a returned power fluid,
(c) analyzing both the produced fluid and the returned power fluid for the concentration of halohydrocarbon or halocarbon contained therein by gas chromatography, using a pulsed electron capture detector, and
(d) calculating the relative amounts of reservoir oil and returned power fluid in the produced oil.

8. The method defined in claim 7 wherein said halohydrocarbon or halocarbon is added as a concentrated solution in a oil solvent.

9. The method defined in claim 7 wherein said halocarbon is tetrachloroethylene.

10. A method for tracing an oil or oil-containing displacement fluid injected into a subterranean reservoir during an enhanced oil recovery process comprising:
(a) incorporating into the oil or oil-containing displacement fluid about 250 to 10,000 weight parts per million of a halogenated hydrocarbon tracer material component comprising at least one halohydrocarbon or halocarbon containing at least 3 halogen atoms and at least 2 carbon atoms per molecule, and having a halogen/carbon atomic ratio of at least one third,
(b) injecting the tracer material-containing oil or oil-containing displacement fluid into the reservoir through an injection well,
(c) producing fluids from the reservoir through a production well,
(d) periodically sampling the produced fluids,
(e) analyzing the produced fluids for halohydrocarbon or halocarbon contained therein by gas chromatography, using a pulsed electron capture detector.

11. The method defined in claim 10 wherein said halohydrocarbon or halocarbon is added as a concentrated solution in a oil solvent.

12. The method defined in claim 10 wherein said halocarbon is tetrachloroethylene.

13. A method for tracing an oil or oil-containing displacement fluid injected into a subterranean reservoir during an enhanced oil recovery process consisting essentially of:
(a) incorporating into the oil or oil-containing displacement fluid about 250 to 10,000 weight parts per million of a halogenated hydrocarbon tracer material component consisting essentially of at least one halohydrocarbon or halocarbon containing at least 3 halogen atoms and at least 2 carbon atoms per molecule, and having a halogen/carbon atomic ratio of at least one third,
(b) injecting the tracer material-containing oil or oil-containing displacement fluid into the reservoir through an injection well,
(c) producing fluids from the reservoir through a production well,
(d) periodically sampling the produced fluids,
(e) analyzing the produced fluids for halohydrocarbon or halocarbon contained therein by gas chromatography, using a pulsed electron capture detector.

14. The method defined in claim 13 wherein said halohydrocarbon or halocarbon is added as a concentrated solution in an oil solvent.

15. The method defined in claim 13 wherein said halocarbon is tetrachloroethylene.

* * * * *